United States Patent [19]

Aston et al.

[11] Patent Number: 4,995,944

[45] Date of Patent: Feb. 26, 1991

[54] CONTROLLING DEPOSITS ON PAPER MACHINE FELTS USING CATIONIC POLYMER AND CATIONIC SURFACTANT MIXTURE

[75] Inventors: David A. Aston; Stewart N. Paul, both of Ontario, Canada

[73] Assignee: Dearborn Chemical Company Ltd., Mississauga, Canada

[21] Appl. No.: 564,658

[22] Filed: Aug. 9, 1990

Related U.S. Application Data

[63] Continuation of Ser. No. 323,597, Mar. 14, 1989, abandoned, which is a continuation-in-part of Ser. No. 245,852, Sep. 16, 1988, abandoned.

[51] Int. Cl.[5] ..... D21F 1/32; D21H 21/02

[52] U.S. Cl. ..... 162/199; 162/DIG. 4

[58] Field of Search ..... 162/5, 199, 186, DIG. 4, 162/158, 164.3, 164.6, 166, 72

[56] References Cited

U.S. PATENT DOCUMENTS

| | | |
|---|---|---|
| 2,979,528 | 4/1961 | Lundsted . |
| 3,016,325 | 1/1962 | Pattiloch . |
| 3,081,219 | 3/1963 | Drennen . |

(List continued on next page.)

FOREIGN PATENT DOCUMENTS

| | | |
|---|---|---|
| 692896 | 8/1964 | Canada . |
| 692897 | 8/1964 | Canada . |
| 1096070 | 2/1981 | Canada . |
| 1136032 | 11/1982 | Canada . |
| 0058622 | 8/1981 | European Pat. Off. . |
| 0069573 | 11/1983 | European Pat. Off. . |
| 0232015 | 8/1987 | European Pat. Off. . |
| 0280445 | 8/1988 | European Pat. Off. . |
| 0289341 | 11/1988 | European Pat. Off. . |
| 61-55294 | 3/1986 | Japan . |
| 770389 | 3/1957 | United Kingdom . |
| 1085918 | 10/1967 | United Kingdom . |
| 1213745 | 11/1970 | United Kingdom . |
| 2159511A | 12/1985 | United Kingdom . |
| 2160538A | 12/1985 | United Kingdom . |

OTHER PUBLICATIONS

C. E. Farley, "Causes of Pitch Problems and a Labaratory Method of Evaluating Control Agents" 1977 TAPPI Papermakers Conference, pp. 23,22.

W. J. Auhorn et al., "Improved Efficiency of Wet End Additives in Closed Wet End Additives in Closed Wet End Systems Through Elimination of Detrimental Substances" 1979 TAPPI Papermakers Conference, pp. 49–66.

D. Horn, "Optisches Zweistrahlverfahren zur Bestimmung von Polyelektrolyten in Wasser and zur Messung

(List continued on next page.)

*Primary Examiner*—Karen M. Hastings

*Attorney, Agent, or Firm*—James P. Barr

[57] ABSTRACT

A method is disclosed for treating papermill felts to inhibit the deposit of sticky material thereon. The method comprises applying an aqueous solution which contains at least about 2 ppm of a cationic polymer; which contains a water soluble cationic surfactant; the surfactant being applied in an amount effective to inhibit build-up of deposits derived from the cationic polymer. Cationic surfactants are preferred. Particular use is disclosed of water soluble surfactants which have a molecular weight between about 200 and 800 and having the general formula:

wherein each R is independently selected from the group consisting of hydrogen, polyethylene oxide groups, polypropylene oxide groups, alkyl groups having between about 1 and 22 carbon atoms, aryl groups, and aralkyl groups, at least one of said R groups being an alkyl group having at least about 8 carbon atoms, and wherein $X^-$ is an anion, or 1/n of an n-valent anion. Compositions comprising said cationic polymers and said surfactants in a weight ratio of surfactant to cationic polymer of from about 50:1 to about 1:1 are disclosed as particularly useful for treating felts.

30 Claims, 2 Drawing Sheets

U.S. PATENT DOCUMENTS

| | | |
|---|---|---|
| 3,140,222 | 7/1964 | Michalski et al. . |
| 3,150,035 | 9/1964 | Eddy . |
| 3,154,466 | 10/1964 | Nothum . |
| 3,250,664 | 5/1966 | Conte et al. . |
| 3,274,050 | 9/1966 | Buckman et al. . |
| 3,288,770 | 11/1966 | Butler . |
| 3,384,536 | 5/1968 | Sandberg et al. . |
| 3,398,047 | 8/1968 | Michalski . |
| 3,573,089 | 3/1971 | Tate . |
| 3,582,461 | 6/1971 | Lipowski et al. . |
| 3,589,521 | 6/1971 | Richter . |
| 3,617,441 | 11/1971 | Farrell . |
| 3,619,351 | 11/1971 | Kolosh . |
| 3,632,507 | 1/1972 | Witt . |
| 3,642,572 | 2/1972 | Endres et al. . |
| 3,734,873 | 5/1973 | Anderson et al. . |
| 3,738,945 | 6/1973 | Panzer . |
| 3,748,220 | 7/1973 | Gard . |
| 3,784,649 | 1/1974 | Buckman . |
| 3,806,405 | 4/1974 | Heidweiller . |
| 3,876,500 | 4/1975 | Csordas . |
| 3,893,885 | 7/1975 | Ziemann et al. . |
| 3,910,815 | 10/1975 | Shelor . |
| 3,981,768 | 9/1976 | Lehtinen . |
| 3,992,249 | 11/1976 | Farley . |
| 4,116,762 | 9/1978 | Gardiner . |
| 4,166,894 | 9/1979 | Schaper . |
| 4,184,912 | 1/1980 | Payton . |
| 4,190,491 | 2/1980 | Drennen et al. . |
| 4,250,269 | 2/1981 | Buckman et al. . |
| 4,250,299 | 2/1981 | Lehrmann et al. . |
| 4,253,912 | 3/1981 | Becker et al. . |
| 4,270,978 | 6/1981 | Fioravanti . |
| 4,313,790 | 2/1982 | Pelton et al. . |
| 4,427,491 | 1/1984 | Radvan et al. . |
| 4,540,469 | 9/1985 | Landstrom . |
| 4,608,123 | 8/1986 | Leahy . |
| 4,698,133 | 10/1987 | Moreland . |
| 4,710,267 | 12/1987 | Elsby et al. . |
| 4,765,867 | 8/1988 | Driesbach et al. . |

OTHER PUBLICATIONS der Polymeradsorption an Grenzflachen" Progr. Colloid & Polymer Sci. 65, pp. 251–264 (1978).

Gard, "Some Procudural Aspects of Chelation in Papermaking" TAPPI vol. 47, No. 1 (1964), pp. 198A–201A.

Hassler, "Pitch Deposits in Papermaking and the Function of Pitch Control Agents", TAPPI Journal (1988).

May et al., "A Versatile New Polymer for Use in the Manufacture of Paper and Paperboard" Appita vol. 32, No. 6, May 1979, pp. 466–468.

Goosens et al., "Flocculation of Microcystalline Cellulose Suspensions with Cationic Polymers: Effect of Agitation", TAPPI vol. 59, No. 2, Feb. 1976, pp. 89–94.

Louche et al., "The Role of Special Electrolytes for the Solution of Operating Problems in Paper and Board Production: Buckman Labs", 11–7–1985.

Chemical Abstracts vol. 105, pate 197 entry 105:99426q, 1986.

Teroson Product Bulletin GR 911, 8/1981.

Grace Product Bulletin Darasperse GR 911, 8/9/1982.

Lonza Inc. Hyamine 3500, publication May 1984.

Alkaril Chemicals, Alkaquat DMB451, publication Jan. 25, 1982.

J. Casey, Pulp & Paper, Chemistry & Chemical Technology vol. 2, 2nd Ed., published 1960–61, pp. 1096–1097.

Cyanamide Magnifloc 573C, published Sep. 1978.

CPS Chemical Agefloc B50 Special, no date is available for this bulletin but a letter dated May 18, 1989 confirms a name change to Agefloc B4508.

Dearsol 6306, published Jan. 1987.

Darasperse 6306 Case History, Bulletin 66–6306.2 and Bulletin 66–6306.1, published Jan. 1987.

Darasperse 6323 Bulletin, published Jan. 1988.

Darasperse 7951 Bulletin, published Oct. 1984.

Darasperse 911, published Dec. 1984.

Dearborn 6321 Bulletin, published Apr. 1986.

CONTROLLING DEPOSITS ON PAPER MACHINE FELTS USING CATIONIC POLYMER AND CATIONIC SURFACTANT MIXTURE

This is a continuation of application Ser. No. 323,597, filed Mar. 14, 1989, now abandoned, which is a continuation-in-part of application Ser No. 245,852, filed Sept. 16, 1985, abandoned Dec. 6, 1989.

FIELD OF THE INVENTION

This invention relates to providing clean sheet felting equipment and the like for paper production and, more particularly, to chemical treatment of papermill felts and the like to control the deposit of sticky material thereon.

BACKGROUND OF THE INVENTION

The manufacture of paper typically involves the processing of a carefully prepared aqueous fiber suspension to produce a highly uniform dry paper sheet. Three steps included in the typical process are sheet forming, where the suspension is directed over a porous mesh or "wire" upon which fibers are deposited while liquid filters through the wire; sheet pressing, where the formed sheet is passed through presses covered with porous "felt" to extract retained water from the sheet, to improve the sheet's uniformity, and to impart surface quality to sheet; and paper drying, where residual water is evaporated from the sheet. The sheet may then be further processed into the finished paper product.

It is well known that evaporation of water is energy intensive and thus relatively expensive. Consequently, efficient papermaking is dependent upon extracting water during the forming and pressing operations, and avoiding sheet defects which render the dried sheet unfit for use. Felts and wires are thus particularly important because they affect not only water removal but, because of their intimate contact with the sheet, the quality of the sheet itself. Deposits allowed to collect on the felt or wire can affect its water removal efficiency, can cause holes in the sheet, and can be transferred to the sheet material to create defects.

The quality of the aqueous fiber suspension used to produce the sheet is dependent upon many factors, including the wood and water used as raw materials, the composition of any recycled material added to the process, and the additives used during preparation of the suspension. Thus a variety of dissolved or suspended materials can be introduced into the manufacturing process, including both inorganic materials such as salts and clays, and materials which are organic in nature such as resins or "pitch" from the wood, as well as inks, latex, and adhesives from recycled paper products. A build up of deposits containing inorganic and/or organic materials on felts and other sheet forming equipment during the manufacturing process is recognized as a troublesome obstacle to efficient papermaking. Particularly troublesome are the sticky materials such as glues, resins, gums and the like which are associated with recycled fibers.

Methods of quickly and effectively removing deposits from the papermill sheet forming equipment are of great importance to the industry. The paper machines could be shut down for cleaning, but ceasing operation for cleaning is undesireable because of the consequential loss of productivity. On-line cleaning is thus greatly preferred where it can be effectively practiced.

The wire belt or cylinder used for sheet forming cycles continuously, as a belt, during production. The sheet-contact portion of the cycle begins where application of the fiber suspension to the wire belt or cylinder is started and continues until the formed sheet is separated from the wire surface; and the return portion of the cycle returns the wire from the position where the formed sheet has been removed from its surface to the beginning of the sheet-contact portion. With wire belts such as Fourdrinier wires, on-line wire cleaning has generally been performed during the return stage (i.e. where the wire is not in contact with the forming sheet) by treating the returning wire with a cleaning liquid (typically water); often by showering the wire with liquid under pressure. The showers can be assisted by mechanical surface cleaning. Use of water showers, with or without mechanical assistance, has not proved entirely satisfactory in preventing a build-up of either organic compounds or inorganic deposits on the wires, and additional materials have been used to provide cleaning liquids which are more effective. Predominantly fibrous or inorganic materials have been successfully removed using water-based formulations containing either acids or alkalis formulated with other chemicals such as surfactants. Where organic deposits are prevalent, they have been removed with some success by using organic solvents, including some formulations containing aromatic compounds with low flash points or chlorinated hydrocarbons. In some machines fine-pored fabric belts are now used instead of the more traditional wires.

Papermill felts also commonly circulate continuously in belt-like fashion between a sheet contact stage and a return stage. During the sheet contact stage water is drawn from the sheet usually with the aid of presses and/or vacuum into the pores of the felt. A clean felt, having fine pores which are relatively open, is especially desirable for effective paper manufacture since this allows efficient removal of water from the paper sheet. A felt cleaning procedure should remove both organic and inorganic deposits of both a general and localized nature, maintain felt porosity, and condition the fabric nap without chemical or physical attack on the substrate. Mechanical removal, typically by blade contact, has been used to remove debris from the felt surface. However, cleaning liquids are also utilized to remove troublesome build-up of organic and inorganic deposits. The fabric composition and conformation of many papermill felts makes them susceptible to chemical degradation. The cleaning chemicals should be easily removed by rinsing. Both continuous and shock cleaning is used in most papermills. The chemicals used include organic solvents, often chlorinated hydrocarbons. Acid and alkali based systems are also used, but at lower concentrations than used in wire cleaning. High concentrations of alkali metal hydroxides are often unsuitable for felt cleaning as they "attack" the fabric material.

Some of the more successful organic solvents have been identified as health risks, such as carcinogens, and thus require especially careful handling. Other solvent based products can damage plastic or rubber components used in the paper forming process. One on-line treatment of felts which we know has been used for several years with some success involves contacting the felt with aqueous solution of cationic surfactants such as alkyldimethyl benzyl ammonium chloride wherein the alkyl group consists of a mixture of $C_{12}H_{25}$, $C_{14}H_{29}$ and $C_{16}H_{33}$ groups. However, experience has shown that some sticky materials still tend to adhere to felts despite treatment with these surfactants. Another felt conditioning practice which has been advocated in the past is application of aqueous solutions of cationic polymers to the felts. However this type of treatment can actually lead to a build-up of deposit of materials derived from the cationic polymers themselves.

Other sheet forming equipment such as deckers, filters, screens, and rolls can also become fouled. The process problems and treatments are, as a general rule, similar to the felt system, although certain considerations such as maintaining porosity and avoiding chemical degradation of fabric, which are important in felt cleaning and cleaning certain other fine-pored equipment components, may not be so critical for this other equipment.

Natural resin or gum in fresh wood can vary, depending on the species. Some types of pine wood, especially those containing 2 weight percent or more of resin, are commonly used in only very low percentages due to the gum and resin problems they cause. Papermakers alum or sodium aluminate have been traditionally used to control natural wood resin deposits. These products are added into the total pulp system with the objective of depositing the resin on the fiber. The effectiveness of this approach is limited by such factors as pH, the potential for corrosion, paper sheet formation, and the need to control interaction with other chemicals in the pulp system. Treatments which would permit the unrestricted use of these problem pine wood sources could have significant beneficial economic impact on some pulp and paper producers.

The increasingly more common use of recycled fiber has contributed to more serious build-ups of sticky material during paper formation. The glues, resins, gums, etc. which are found in recycled, secondary fiber tend to adhere to various parts of the paper-forming machine and to resist on-line shower cleaning. The materials which adhere to the felt can seriously affect drainage and paper formation. The end result in the product is holes, and ultimately, in some cases, breaks in the sheet during paper processing. Frequent shutdown may be necessary to solvent wash the felt to remove the particularly sticky material associated with recycled fiber. The advantages of paper recycling can thus be somewhat offset by reduced productivity of the papermaking machines.

Certain organic cleaners which were used frequently in the past have become environmentally undesirable. Thus, greater need has developed for cleaners which remove organic deposits without presenting an environmental hazard. Naturally, formulations used should not be destructive of the felts or other sheet forming equipment. While some materials have been considered to perform satisfactorily under certain conditions, there is still a continuing need for more effective deposit control agents for paper forming, particularly where recycled fiber is used as a raw material.

Another approach to deposit control has been the use of pulp additives such as anionic aryl sulfonic acid-formaldehyde condensates or cationic dicyandiamide-formaldehyde condensates. The additives may function for example as sequestrants, dispersing agents or surface active agents. In particular the cationic dicyandiamide-formaldehyde aminoplast resins have been described as bringing about the attachment of pitch (e.g. resinous matter and gums), in the form of discrete particles, to pulp fibers so that the pitch particles are uniformly distributed on the fibers themselves. Consequently, the amount of pitch which accumulates on the papermaking machine is reportedly reduced without causing dark spots or specks of pitch in the paper product.

SUMMARY OF THE INVENTION

We have found that the deposit of sticky material from papermaking pulp onto papermill felts and other papermaking equipment used in processing a pulp slurry into sheets can be inhibited by applying to the equipment an aqueous solution containing at least about 2 ppm of a cationic polymer and applying to the equipment an aqueous solution containing compounds selected from the group consisting of water-soluble nonionic and cationic surfactants in an amount effective to inhibit build-up of deposits derived from the cationic polymer. Preferably, the aqueous solution containing the cationic polymer and surfactant is substantially free of anionic macromolecules. Preferred cationic polymers include protonated or quaternary ammonium polymers such as polymers formed by reacting epihalohydrins with dimethylamine or diethylamine. Preferred cationic surfactants include alkyldimethyl benzyl ammonium chlorides having alkyl groups with between about 12 and 16 carbon atoms. The invention is particularly beneficial when used for treating felts and like equipment components used in processing pulp slurry into sheets.

An object of this invention is to provide a process which can effectively control the deposit of material on paper-forming equipment.

Another object of this invention is to provide a papermill deposit control process which has improved effectiveness for papermaking with recycled or high resin pine pulp fiber.

Yet another object of this invention is to provide a papermill deposit control process which is environmentally acceptable.

Still another object of this invention is to provide a means for increasing the productivity and product quality in papermaking processes.

These and other objects and advantages of the present invention will become apparent from the following detailed description of the invention.

DETAILED DESCRIPTION

Figure 1:
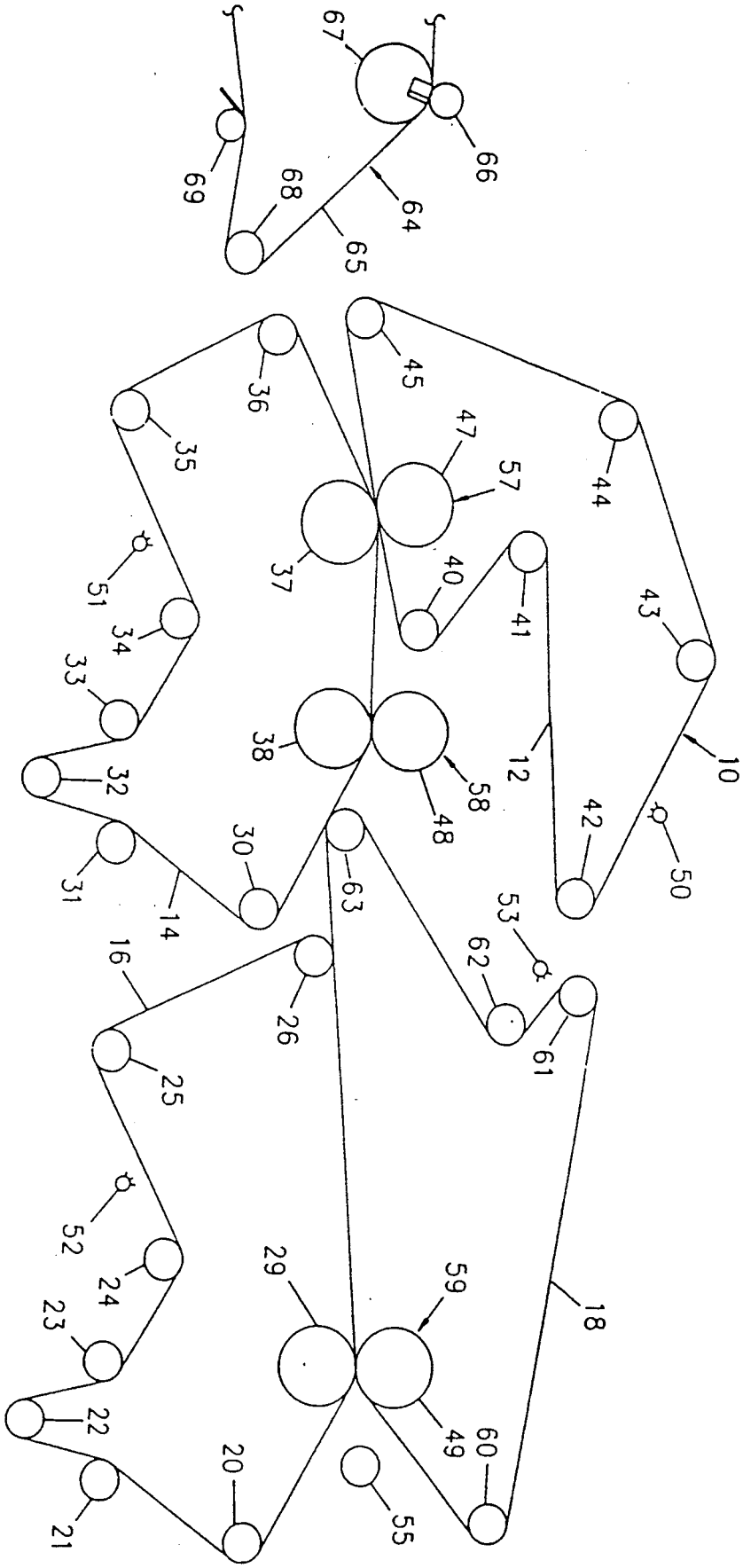
FIG. 1 is a schematic side elevation drawing of felts in a papermaking machine which can be treated in accordance with the present invention.

The present invention is directed to using aqueous solutions of certain water-soluble cationic polymers and certain water-soluble surfactants to substantially inhibit the deposit of both organic and inorganic deposits on felts or other sheet forming equipment, especially other fine-pored components of such equipment. Treatment, including a cationic polymer in combination with a cationic surfactant, provides surprisingly effective control of deposits on the treated equipment, even where recycled fiber represents a substantial portion of the pulp formulation. The invention provides a particularly effective felt cleaner and conditioner for paper machines.

The present invention is of general applicability as regards the precise nature of the polymer, and a considerable variety of different polymers can be used, provided that they are cationic. Use of polyethylenimines is considered to be within this invention, as is use of various other polymeric materials containing amino groups such as those produced in accordance with the procedure disclosed in U.S. Pat. Nos. 3,250,664, 3,642,572, 3,893,885 or 4,250,299; but it is generally preferred to use protonated or quaternary ammonium polymers. These preferred polymers include polymers obtained by reaction between an epihalohydrin and one or more amines, and polymers derived from ethylenically unsaturated monomers which contain a quaternary ammonium group. The cationic polymers of this invention also include dicyandiamide-formaldehyde condensates. Polymers of this type are disclosed in U.S. Pat. No. 3,582,461, which is incorporated herein in its entirety. Either formic acid or ammonium salts, and most preferably both formic acid and ammonium chloride, may also be included as polymerization reactants. However, some dicyandiamide-formaldehyde condensates have a tendency to agglomerate on felts and the like, even in the presence of cationic surfactants. One dicyandiamide-formaldehyde type polymer is commercially available as Tinofix QF from Ciba Geigy Chemical Ltd. of Ontario, Canada and contains as its active ingredient about 50 weight percent of a polymer believed to have a molecular weight between about 20,000 and 50,000.

Among the quaternary ammonium polymers which are derived from epihalohydrins and various amines are those obtained by reaction of epichlorohydrin with at least one amine selected from the group consisting of dimethylamine, ethylene diamine, and polyalkylene polyamine. Triethanolamine may also be included in the reaction. Examples include those polymers obtained by reaction between a polyalkylene polyamine and epichlorohydrin, as well as those polymers obtained by reaction between epichlorohydrin, dimethylamine, and either ethylene diamine or a polyalkylene polyamine. A typical amine which can be employed is N,N,N',N'-tetramethylethylene-diamine as well as ethylene diamine used together with dimethylamine and triethanolamine. Polymers of this type include those having the formula:

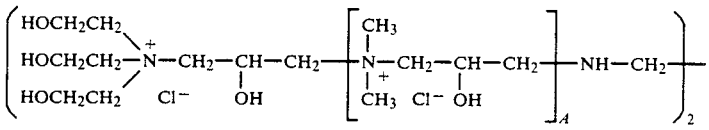

where A is from 0–500, although, of course, other amines can be employed.

The preferred cationic polymers of this invention also include those made by reacting dimethylamine, diethylamine, or methylethylamine, preferably either dimethylamine or diethylamine, with an epihalohydrin, preferably epichlorohydrin. Polymers of this type are disclosed in U.S. Pat. No. 3,738,945, and Canadian Pat. No. 1,096,070, which are incorporated herein in their entirety. Such polymers are commercially available as Agefloc A-50, Agefloc A-50HV, and Agefloc B-50 from CPS Chemical Co., Inc. of New Jersey, U.S.A. These three products reportedly contain as their active ingredients about 50 weight percent of polymers having molecular weights of about 75,000 to 80,000, about 200,000 to 250,000, and about 20,000 to 30,000, respectively. Another commerically available product of this type is Magnifloc 573C, which is marketed by American Cyanamide Company of New Jersey, U.S.A. and is believed to contain as its active ingredient about 50 weight percent of a polymer having a molecular weight of about 20,000 to 30,000.

Typical cationic polymers which can be used in the present invention and which are derived from ethylenically unsaturated monomers include homo- and copolymers of vinyl compounds such as vinyl pyridine and vinyl imidazole which may be quaternized with, say, a $C_1$ to $C_{18}$ alkyl halide, a benzyl halide, especially a chloride, or dimethyl or diethyl sulphate, or vinyl benzyl chloride which may be quaternized with, say, a tertiary amine of formula $NR_1R_2R_3$ in which $R_1$, $R_2$ and $R_3$ are independently lower alkyl, typically of 1 to 4 carbon atoms, such that one of $R_1$, $R_2$, and $R_3$ can be $C_1$ to $C_{18}$ alkyl; allyl compounds such as diallyldimethyl ammonium chloride; or acrylic derivatives such as dialkyl aminomethyl(meth)acrylamide which may be quaternized with, say, a $C_1$ to $C_{18}$ alkyl halide, a benzyl halide or dimethyl or diethyl sulphate, a methacrylamido propyl tri($C_1$ to $C_4$ alkyl, especially methyl) ammonium salt, or a (meth)acryloy-loxyethyl tri($C_1$ to $C_4$ alkyl, especially methyl) ammonium salt, said salt being a halide, especially a chloride, methosulphate, ethosulphate, or 1/n of an n-valent anion. These monomers may be copolymerized with a (meth)acrylic derivative such a acrylamide, an acrylate or methacrylate $C_1$–$C_{18}$ alkyl ester or acrylonitrile or an alkyl vinyl ether, vinyl pyrrolidone, or vinyl acetate. Typical such polymers contain 10–100 mol % of recurring units of the formula:

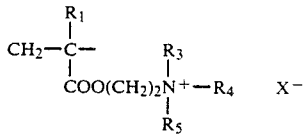

and 0–90 mol % of recurring units of the formula:

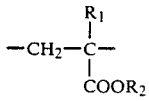

in which $R_1$ represents hydrogen or a lower alkyl radical, typically of 1–4 carbon atoms, $R_2$ represent long chain alkyl group, typically of 8 to 18 carbon atoms, $R_3$, $R_4$, and $R_5$ independently represent hydrogen or a lower alkyl group while X represents an anion, typically a halide ion, a methosulfate ion, an ethosulfate ion, or 1/n of a n-valent anion.

Other quaternary ammonium polymers derived from an unsaturated monomer include the homo-polymer of diallyldimethyl ammonium chloride which possesses recurring units of the formula:

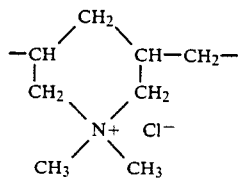

In this respect, it should be noted that this polymer should be regarded as "substantially linear" since although it contains cyclic groupings, these groupings are connected along a linear chain and there is no crosslinking.

Other polymers which can be used and which are derived from unsaturated monomers include those having the formula:

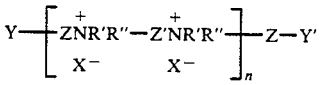

where Z and Z' which may be the same or different is $-CH_2CH=CHCH_2-$ or $-CH_2-CHOHCH_2-$, Y and Y', which may be the same or different, are either X or $-NR'R''$, X is a halogen of atomic weight greater that 30, n is an integer of from 2 to 20, and R' and R'' (i) may be the same or different alkyl groups of from 1 to 18 carbon atoms optionally substituted by 1 to 2 hydroxyl groups; or (ii) when taken together with N represent a saturated or unsaturated ring of from 5 to 7 atoms; or (iii) when taken together with N and an oxygen atom represent the N-morpholino group. A particularly preferred such polymer is poly(dimethylbutenyl) ammonium chloride bis-(triethanol ammonium chloride).

Another class of polymer which can be used and which is derived from ethylenically unsaturated monomers includes polybutadienes which have been reacted with a lower alkyl amine and some of the resulting dialkyl amino groups are quaternized. In general, therefore, the polymer will possess recurring units of the formula:

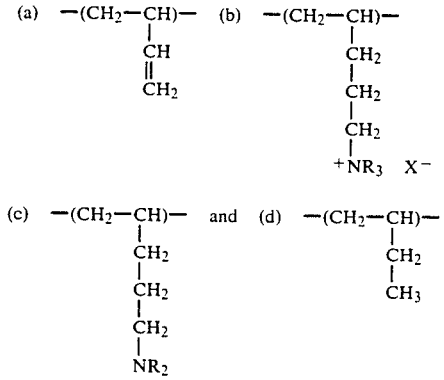

in the molar proportions $a:b_1:b_2:c$, respectively, where R represents a lower alkyl radical, typically a methyl or ethyl radical. It should be understood that the lower alkyl radicals need not all be the same. Typical quaternizing agents include methyl chloride, dimethyl sulfate, and diethyl sulfate. Varying ratios of $a:b_1:b_2:c$ may be used with the amine amounts $(b_1+b_2)$ being generally from 10–90% with $(a+c)$ being from 90%–10%. These polymers can be obtained by reacting polybutadiene with carbon monoxide and hydrogen in the presence of an appropriate lower alkyl amine.

Other cationic polymers which are capable of interacting with anionic macromolecules and/or sticky material in papermaking pulp may also be used within the scope of this invention. These are considered to include cationic tannin derivatives, such as those obtained by a Mannich-type reaction of tannin (a condensed polyphenolic body) with formaldehyde and an amine, formed as a salt, eg. acetate, formate, hydrochloride or quaternized, as well as polyamine polymers which have been crosslinked, such as polyamideamine/polyethylene polyamine copolymers crosslinked with, say, epichlorohydrin. Natural gums and starches which are modified to include cationic groups are also considered useful.

The molecular weight of the most useful polymers of this invention is generally between about 2,000 and about 3,000,000, although polymers having molecular weights below 2,000 and above 3,000,000 may also be used with some success. Preferably the molecular weight of the polymer used is at least about 10,000, and is most preferably at least about 20,000. Preferably the molecular weight of the polymer used is about 300,000 or less, and is most preferably about 50,000 or less. The polymers most preferably have a molecular weight within the range of about 20,000 to about 50,000. Mixtures of these polymers may also be used.

The present invention is also of general applicability as regards the precise nature of nonionic and cationic surfactants which may be used, and a considerable variety of different surfactants can be used in combination with the polymer component, provided that they are water soluble. Suitable nonionic surfactants include condensation products of ethylene oxide with a hydrophobic molecule such as, for example, higher fatty alcohols, higher fatty acids, alkylphenols, polyethylene glycol, esters of long chain fatty acids, polyhydric alcohols and their partial fatty acid esters, and long chain polyglycol partially esterfied or etherified. A combination of these condensation products may also be used.

Cationic surfactants are generally preferred. Particularly preferred cationic surfactants suitable for use in this invention include water soluble surfactants having molecular weights between about 200 and 800 and having the general formula

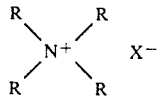

wherein each R is independently selected from the group consisting of hydrogen, polyethylene oxide groups, polypropylene oxide groups, alkyl groups having between about 1 and 22 carbon atoms, aryl groups, and aralkyl groups, at least one of said R groups being an alkyl group having at least about 8 carbon atoms and preferably an n-alkyl group having between about 12 and 16 carbon atoms; and wherein $X^-$ is an anion, typically a halide ion (e.g. chloride), or 1/n of an n-valent anion. Mixtures of these compounds can also be used as the surfactant of this invention.

Preferably two of the R groups of the cationic surfactants of the formula are selected from the group consisting of methyl and ethyl, and are most preferably methyl; and preferably one R group is selected from the aralkyl groups

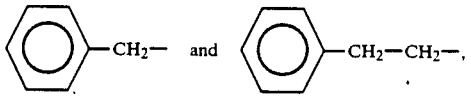

and is most preferably benzyl. Particularly useful surfactants thus include alkyl dimethyl benzyl ammonium chlorides having alkyl groups with between about 12 and 16 carbon atoms. One commercially available product of this type includes a mixture of alkyl dimethyl benzyl ammonium chlorides wherein about 50% of the surfactant has a $C_{14}H_{29}$ n-alkyl group, about 40% of the surfactant has a $C_{12}H_{25}$ n-alkyl group, and about 10% of the surfactant has a $C_{16}H_{33}$ n-alkyl group. This product is known for its microbicidal effectiveness.

The surfactants considered suitable for use in this invention also include the group of pseudo-cationic materials having a molecular weight between about 1,000 and about 26,000 and having the general formula $NR_1R_2R_3$, wherein $R_1$ and $R_2$ are polyethers such as polyethylene oxide, polypropylene oxide or a combined chain of ethylene oxide and propylene oxide, and wherein $R_3$ is selected from the group consisting of polyethers, alkyl groups, or hydrogen. Examples of this type of surfactant are disclosed in U.S. Pat. No. 2,979,528.

We have found that when the cationic polymers of this invention are applied together with the nonionic and/or cationic surfactant to felts, the felts resist the build-up of sticky deposits. In particular, the adhesion of sticky material associated with recycled fiber is effectively controlled. Thus, the invention is particularly advantageous for papermaking systems employing a substantial proportion, say, at least about 10%, recycled fiber. Moreover, outstanding results have been obtained in systems wherein recycled material accounts for at least 70% of the fibers, and even for systems when the papermill pulp fibers are derived about 100% from recycled material. The invention is also considered particularly advantageous for controlling resin deposit from fiber, substantially derived (say, 5% or more) from pine wood containing greater than two weight percent or more resin.

While the mechanism of this phenomenon is not completely understood, it is well known that adhesive materials associated with recycled fiber are generally hydrophobic, and it is believed that the products formed after interaction of those hydrophobic materials with the cationic components of this invention more readily associate with water. The wetted adhesive materials may thus substantially lose their tendency to adhere to the underlying felt surface so that they can be easily removed from the felts. It is also known that papermaking pulp contains colloidal materials and anionic macromolecules, including synthetic anionic macromolecules which might be added as part of the papermaking process as well as those natural anionic polymers, resins, soaps, surfactants and organic acids (e.g. abietic acid) which have become associated in the industry with "anionic trash". It is believed that the cationic components applied in accordance with this invention may interact with the anionic macromolecules and colloidal particles to form products which can be easily removed from felts. In any case, the tendency of adhesive material to pass by papermaking equipment rather than adhering to it, is greatly increased by treatment in accordance with this invention.

The cationic polymers and the surfactants of this invention are applied in aqueous solution directly to the equipment being treated. A treatment with the surfactant alone has not provided the degree of deposit control which can be obtained by the combinations of this invention. On the other hand, over-application of polymer to papermill felt, without sufficient surfactant will result in a build-up of deposits derived from the polymer itself and thus, in the case of felts, in reduced porosity which can eventually retard water removal or otherwise effect production (e.g. by increasing tackiness). Thus, the treatment dosage of polymer and surfactant should generally be adjusted to the demands of the particular system being treated. Preferably, the aqueous solution containing the cationic polymer and the surfactant should be substantially free of anionic macromolecules. These anionic materials include natural materials such as wood lignins, byproducts of chemical pulping such as sodium lignosulfonates, and synthetic materials such as polyacrylates.

The polymers and surfactants of this invention are typically supplied as liquid compositions comprising aqueous solutions of the polymer and/or surfactant. Polymer concentrations in the compositions may range from the relatively dilute solutions having polymer concentrations suitable for continuous application, up to the solubility or gelling limits of the polymer, but generally the compositions are relatively concentrated for practical shipping and handling purposes. Indeed, the liquid compositions may comprise additional materials which further the dissolution of the polymers so as to allow more concentrated compositions. An example of these materials are alkoxyethanols such as butoxyethanol. Aqueous compositions suitable for shipping and handling will generally contain between 5 and 50 weight percent, active, of the cationic polymer of this invention. While the cationic surfactants of this invention may be supplied as compositions separate from the polymer compositions and then either applied to the felts separately (e.g. by using separate shower systems) or mixed prior to application, it is preferred to provide aqueous compositions comprising the cationic surfactant as well as the cationic polymer. While other agents may also be present in the compositions of this invention, useful compositions may be provided in accordance with this invention which contain a pitch control agent consisting essentially of the above-described cationic surfactants and cationic polymers. In general, aqueous compositions suitable for shipping and handling will contain between 5 and 50 weight percent total of the polymer and surfactant components. The weight ratio of surfactant to polymer in such combined compositions is generally between about 50:1 and 1:50. Preferably the weight ratio of surfactant to polymer in the aqueous composition is between about 10:1 and about 1:1, especially where oils may potentially be present; and is most preferably about 1:1 for general application, although excess surfactant (e.g. a weight ratio of 1.1:1, or more) may be considered most suitable in the event oils might be present.

One aqueous formulation considered particularly suitable for separate application of the polymer component in conjunction with additional application of the surfactant is available commercially from Dearborn Chemical Co., Ltd. of Ontario, Canada and comprises about 17 weight percent, active, of a polymeric condensation product of formaldehyde, ammonium chloride, dicyandiamide and formic acid which has a molecular weight believed to be about 20,000 to 50,000, about 2 weight percent, active, of a polymer derived by reacting epichlorohydrin with dimethylamine which has a molecular weight believed to be about 20,000 to 30,000, and about 8 weight percent of butoxyethanol. Lesser amounts of other materials, including about 0.4% active of an alkyldimethyl ammonium chloride surfactant containing the mixture of $C_{12}$, $C_{14}$ and $C_{16}$ n-alkyl substituents described above are also present in said product, but are not considered essential to its utility for separate addition. In particular the relative amount of alkyldimethyl ammonium chloride surfactant in this product is considered insufficient to activate the polymer deposit inhibiting effect of this invention. Another aqueous formulation considered particularly suitable for separate addition of the polymer, also available commercially from Dearborn Chemical Co., Ltd., comprises about 17 weight percent, active, of a poly(hydroxyalkylene dimethyl ammonium chloride) having a molecular weight of about 20,000. An aqueous formulation considered particularly suitable for separate addition of the surfactant to this invention, also available commercially from Dearborn Chemical Co., Ltd., comprises about 16% active of the alkyldimethyl benzyl ammonium chloride surfactant mixture described above.

The most appropriate treatment dosage depends on such system factors as the nature of the adhesive material, and whether cleaning is continuous or periodic. Even liquid compositions comprising relatively high concentrations of a polymer of the invention (for example, 50%) may be employed at full strength (100% as the liquid composition), for example by spraying the undiluted liquid composition directly onto the felts. However, particularly where continuous treatment is practiced, the compositions may be advantageously diluted at the treatment location with clean fresh water or other aqueous liquid. Where necessary for water economy, a good quality process water may be adequate for dilution.

The advantages of this invention can be realized at application concentrations as low as 2 ppm of the polymer, especially where continuous treatment is practiced, and, as explained further below, sufficient surfactant to inhibit a build-up of deposits derived from the applied cationic polymer component. "Continuous treatment" of felt as used herein means that the felt is routinely treated at least once during the cycle between its sheet contact stage and its return stage. This routine treatment is most advantageously applied during the early portion of return stage. The felt can then be contacted with the sheet such that even the sticky material, including that typically associated with recycled fibers, is inhibited from adhereing to the felt, and that material which does deposit is more readily washed away when aqueous wash solution is applied during the return stage. In some cases, continuous treatment is not practical and treatment with the cationic polymers and surfactants of this invention may be periodic. For example, aqueous solutions of the polymer and surfactant may be sprayed on the felt until the felt is satisfactorily conditioned and the spray may then be discontinued until supplemental conditioning is needed to further inhibit the build-up of deposits on the felt.

Treatment procedures are more specifically described by reference to the model papermaking felt systems schematically represented in simplified form in FIGS. 1 and 2. The press felt system represented generally as (10) in FIG. 1 comprises a top press felt (12), a bottom press felt (14) a final press bottom felt (16) and final press top felt (18). Final press bottom felt (16) is shown wound about a series of rolls (20), (21), (22), (23), (24), (25), and (26) and press roll (29); bottom press felt (14), is shown wound about a series of rolls (30), (31), (32), (33), (34), (35) and (36) and press rolls (37) and (38); top press felt (12) is shown wound about a series of rolls (40), (41), (42), (43), (44) and (45) and press roll (47); and final press top felt is shown wound about the press roll 49 and a series of rolls (60), (61), (62) and (63). Both top press felt (12) and bottom press felt (14) pass between press rolls (37) and (47). Bottom press felt (14) passes between press rolls (38) and (48); and both final bottom press felt (16) and final press top felt (18) pass between press rolls (29) and (49) Showers for washing the top press felt (12), the bottom press felt (14), the final press bottom felt (16) and the final press top felt (18) are respectively shown at (50), (51), (52) and (53). A sheet support roll is shown at (55). Press (57) comprises press rolls (37) and (47); press (58) comprises press rolls (38) and (48); and press (59) comprises press rolls (29) and (49).

The press felt system (10) is shown in FIG. 1 positioned to receive sheet material from a Fourdrinier wire-type machine represented only partially by (64) in FIG. 1, wherein a wire (65) is designed to receive an aqueous paper stock from a head box (not shown). Liquid then filters through openings in the wire as the wire travels during its sheet contact stage to a lump breaker roll (66) and a couch roll (67) which are generally provided to physically compress the sheet material and remove it from the wire (65). The wire (65) then passes over the head roll (68) and returns to receive additional paper stock. The return is typically directed past a series of showers (not shown), and wash rolls such as that shown at (69). Other showers (not shown), may be provided for particular components of the system, such as the lump broken roll (66) or the head roll (68).

During operation of the felt system shown in FIG. 1, sheet material removed from the wire (65) after couch roll (67) is directed between rolls (45) and (36) and pressed between the top press felt (12) and the bottom press felt (14) by press rolls (37) and (47) of press (57). The sheet material then travels along with bottom press felt (14) to press (58) where it is pressed between the bottom press felt and press roll (48) using press roll (38). The sheet material is then removed from the bottom press felt (14) and travels on to press (59) where it is pressed between the final press bottom felt (16) and the final press top felt (18) by press rolls (29) and (49) of press (59). The sheet material is then removed from the final press felt (16) and travels over support roll (55) and on to further processing equipment such as dryers (not shown). In the press felt system (10) as shown in FIG. 1, the sheet contact stage of the top press felt (12) lasts from roll (45) or some point between roll (45) and press (57) until some point after sheet contact stage of the bottom press felt (14) lasts from some point between roll (36) and press (57); until some point after press (58); the sheet contact stage of final press bottom felt (16) lasts from roll (26) until some point after press (59); and the sheet contact stage of final press top felt (18) lasts from some point between roll (63) and press (59) until some point after press (59).

It will be evident that additional equipment such as various presses, rolls, showers, guides, vacuum devices, and tension devices may be included within the felt system 10. In particular wringer presses for pressing moisture from the felts themselves may be provided. Moreover some of the equipment shown such as press (58) and final press top felt (18) may be omitted from a felt system. It will be further evident to one of ordinary skill in the art that felt systems are highly variable both with regard to the number of felts used and the design of the felt cycling systems.

Felt systems are also used in conjunction with papermaking processes which do not employ Fourdrinier wire formers. One such alternate system, which is especially useful for producing heavier sheet material, uses vat formers. The initial stages of a vat forming system are represented generally in FIG. 2. The system (70) comprises a series of wire cylinders (i.e. vats) as those shown at (72) and (73) which rotate so that a portion of the cylinder is brought into contact with the pulp slurry and is then rotated to deposit a layer of paper web onto a bottom couch felt (75). In addition to the bottom couch felt (75) the system (70) comprises a first top couch felt (76) and a second top couch felt (77). Couch rolls (78) and (79) are provided to aid in the transfer of sheet material from the vats (72) and (73) respectively onto the bottom couch felt (75). The bottom couch felt (75) is shown wound about couch rolls (78) and (79), roll (80), suction drum (81) and press rolls (83), (84), (85) and (86) The first top couch felt is shown wound about rolls (88), (89) and (90) and suction drum couch roll (91); and the second top couch felt is shown wound about press rolls (93), (94), (95) and (96) and rolls (97), (98), (99) and (100). Both the bottom couch felt (75) and the first top couch felt (76) pass between the suction drum (81) and the suction drum couch roll (91) which vacuum water from the felts and fiber web. Both the bottom couch felt (75) and the second top couch felt (77) pass between press rolls (83) and (93), between press rolls (84) and (94), between press rolls (85) and (95), and between press rolls (86) and (96). Press (103) comprises press rolls (83) and (93); press (104) comprises press rolls (84) and (94); press (105) comprises press rolls (85) and (95); and press (106) comprises press rolls (86) and (96).

Showers for washing the bottom couch felt (75), the first top couch felt (76) and the second top couch felt (77) are respectively shown at (107), (108) and (109).

Figure 2:
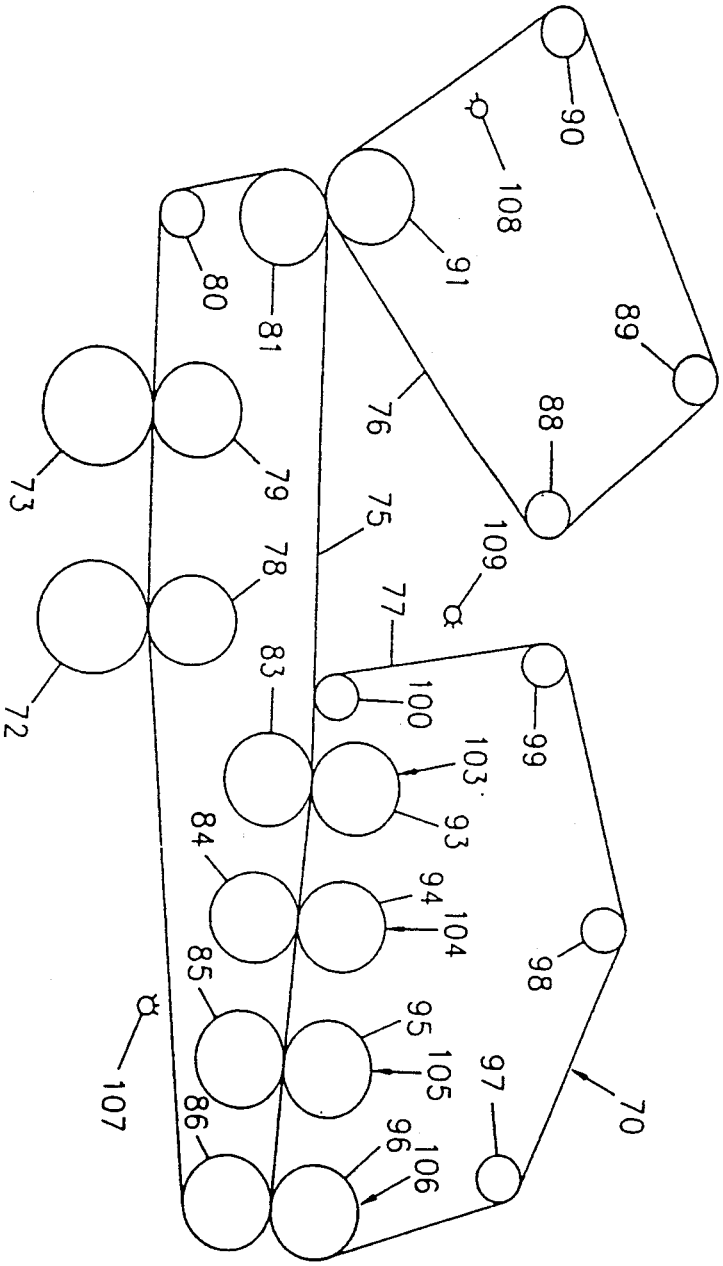
FIG. 2 is a schematic side elevation drawing of felts in a vat forming papermaking machine which can be treated in accordance with the present invention.

During operation of the felts shown in FIG. 2, sheet material removed from the vats (72) and (73) travels on the bottom couch felt (75) over the suction drum and is pressed between the bottom couch felt and the second top couch felt (77) by each of the presses (103), (104), (105) and (106). The sheet material is then separated from the couch felts (75) and (77) and is directed onto further processing equipment such as the felt system (10) shown in FIG. 1. In the system shown in FIG. 2 the sheet contact stage of the bottom couch felt (75) lasts from the vat (72) until just after press roller (86); the sheet contact stage of the first top couch felt is at the suction drum couch roll; and the sheet contact state of the second top couch felt lasts from about roll (100) to until just after press roller (96). It will be evident that additional equipment such as vats, presses, rolls, showers, guides, vacuum devices, and tension devices may be included within the system (70). Moreover some of the equipment shown may be omitted from a vat forming system. It will be fairly evident to one of ordinary skill in the art that vat forming systems are highly variable both with regard to the number of felts used and the design of the felt cycling systems.

Each felt (12), (14), (16), (18), (75), (76) and (77) of the systems illustrated in FIGS. 1 and 2 can be continuously treated in accordance with this invention by applying an aqueous solution of suitable cationic polymer and surfactant to the felt anywhere along its return stage (i.e. from the point the felt is separated from contact with sheet material to the point it is again brought into contact with sheet material). Preferably the solution is sprayed onto the felt early in its return stage, so that adhesive material transferred from the sheet material to the felt can be quickly treated. However, the treatment location is often restricted by felt system design. Thus, showers such as shown at (50), (51), (52), (53), (107), (108) and (109) in FIGS. 1 and 2 may be used for treatment purposes. In cases where the applied solution is of a higher concentration than needed for continuous treatment, the application can be interrupted and then resumed as needed. For example, where a shower such as those shown at (50), (51), (52), (53), (107), (108) and (109) is used to apply the solution, it may be intermittently activated and turned off according to the demands of the system. Equipment other than felts may be similarly treated in a manner compatible with their process operation.

For typical papermaking processes, particularly those using substantial amounts of recycled fiber, the cationic polymer is generally applied at a rate at least about 0.002 grams per square meter of felt per minute ($g/m^2$-min), preferably about 0.01 $g/m^2$-min or more where continuous treatment is used, and preferably about 0.02 $g/m^2$-min or more during the application period where application is intermittent. Preferably polymer application rates of 0.5 grams per square meter per minute or less are used to minimize the potential for felt plugging. Thus, for standard papermaking machines with felt widths of 2 to 7 meters and felt lengths of 10 to 40 meters, the application rate is commonly between about 0.02 and 20 grams of polymer per minute per meter width (i.e. g/m-min), more commonly between about 0.05 and 12.5 g/m-min. One technique involves applying 1 g/m-min or more initially, until the felt is conditioned. Once conditioning has been accomplished, maintenance polymer application rates may be lower, or as explained above, application may even be discontinued periodically. The surfactant is applied to felts at a rate effective to inhibit build-up of deposits derived from the applied polymer and thus, is important in controlling felt plugging. Accordingly the weight ratio of surfactant to polymer is generally kept between about 50:1 and 1:50. Preferably, in order to provide sufficient surfactant to control the build-up of deposits derived from the polymer and to offer protection from incidental amounts of dirt and oily materials from the pulp the weight ratio of surfactant to polymer is about 1:1 or more; and in order to avoid applying excessive surfactant, the weight ratio of surfactant to polymer is preferably about 10:1 or less. Most preferably the ratio of the two components is about 1:1. In any case, we prefer to apply the surfactant at a concentration of at least about 1 ppm. Other equipment such as wires, screens, filters, rolls, and suction boxes, and materials such as metals, granite, rubber, and ceramics may also be advantageously treated in accordance with this invention. However, the invention is particularly useful in connection with treating felts and like equipment components with pores suitable for having water drawn therein (i.e. relatively fine pores) where the build-up of substantial deposits derived from the polymer is undesirable; as opposed for example to other equipment such as metal and plastic wires having relatively large pores for draining water therethrough, where a certain amount of deposit build-up is not considered to create undesirable problems.

In any case, the concentration of cationic polymer in the aqueous solution ultimately applied to the felt or other papermaking equipment should be at least about 0.0002 weight percent. Preferably, in order to enhance the uniformity of distribution of the polymer, continuous treatment of felt through a felt shower system in accordance with this invention will be conducted with an aqueous shower solution having between about 0.0002 weight percent and about 0.02 weight percent of cationic polymer.

Practice of the invention will become further apparent from the following non-limiting examples.

EXAMPLE I

The test of this example was made on a papermaking machine having a Fourdrinier wire former. The machine had a top first press felt, a bottom first press felt, a top second press felt, and a bottom second press felt somewhat analagous to the top press felt (12), bottom press felt (14), final press top felt (18), and final press bottom felt (16) shown in FIG. 1 respectively. Each of the felts had showers. The first press felts received sheet material from a Fourdrinier wire situated somewhat analagously to the unit (64) shown in FIG. 1, and produced corrugated media from stock having about 20% secondary (recycle) fiber and about 80% hardwood virgin fiber.

The sheet material formed on the wire was separated therefrom and directed to a first press somewhat analagous to the press (57) in FIG. 1 where it was pressed between the top first press felt and the bottom first press felt. The sheet was in turn separated from the first press felts and directed to a second press somewhat analagous to the press (59) in FIG. 1 where it was pressed between the top second press felt and the bottom second press felt.

The mill had previously been experiencing deposit build-up on press felts, particularly on the top second press felt. The deposits were attributable to pitch and sticky material originating from the pulp and recycled material and picked up from the fiber web contacting the felts. Sheet breaks at the second press had been a continuing problem, sometimes occurring as frequently as once per eight-hour shift. Periodic shutdowns were thus necessary to reduce the number of sheet breaks. The top second press felt was approximately 20 feet wide and 61.5 feet long (i.e. the top second press felt had a treatment area of about 114.3 $m^2$).

The top second press felt was treated in accordance with this invention by mixing into the shower water of an existing high pressure shower situated somewhat analagously to shower (53) in FIG. 1 a test product containing approximately 7.5% by weight of the alkyldimethyl benzyl ammonium chloride mixture described above which contains $C_{12}$, $C_{14}$ and $C_{16}$ n-alkyl substituents, and approximately 7.5% by weight of a polymer having a molecular weight of about 20,000 and derived from dimethylamine and epichlorohydrin, and about 85% solvent (the solvent consisted principally of water with minor amounts of any incidental materials such as ethanol which were intermixed in the commercial supply of the surfactant and/or polymer). The initial dosage was about 0.06 g/min/$m^2$ of each component, and the dosage was subsequently reduced after four hours to about 0.02 to 0.03 g/min/$m^2$.

The efficacy of the treatment was monitored by a Huyck & Smith porosity tester and by the number of breaks occurring in the second press section. The porosity of the felt is considered a measure of its capacity to absorb water from the sheet. A felt with high porosity (i.e. more open pores) is considered desirable for sheet dewatering.

The relative porosity of the top second press felt was monitored over the 21-day trial by using the Huyck & Smith procedure which provides relative porosity numbers (H.S. Nos.) ranging from a high of 100% for non-porous or plugged felts to lower percentages for more porous felts. The H.S. No. for the top second press felt was maintained at about 35% for the first several days of the test. Feed of the treatment product was inadvertently interrupted for over 24 hours. An increase of the H.S. No. to about 50% was observed and was attributed to this interruption in treatment. The felt was cleaned and the test was resumed. Following resumption of treatment the H.S. No. decreased to about 45% where it was maintained for several days. The dosage of each treatment component was then reduced by about half due to pump malfunction, and an increase in H.S. No. to 53% was observed. The dosage was returned to its prior level and the H.S. No. was maintained at about 53% for the duration of the test.

The porosity measurements made during the test showed that where the polymer and surfactant were applied in accordance with this invention, the porosity of the felt could be maintained. When the feed was interrupted, felt plugging increased by approximately 15 to 40 percent. In addition, sheet breaks caused by the top second press felt were eliminated for the entire 30-day trial period. Accordingly it was concluded that treatment in accordance with this invention prevented breaks and shut-downs attributable to deposits at the second press; that the treatment prevented adherents accumulation on the treated felt; and that felt plugging by fibres was significantly reduced during treatment.

EXAMPLE II

The test of this example was made on a vat former type (rather than Fourdrinier) papermaking machine. The machine had a primary bottom felt, a suction drum couch felt and a primary top felt somewhat analagous to the bottom couch felt (75), the first top couch felt (76) and the second top couch felt (77) shown in FIG. 2, respectively. The machine also had a secondary top felt, a secondary bottom felt and a final felt somewhat analagous to the top press felt (12), bottom press felt (14) and final press bottom felt (16) shown in FIG. 1, respectively. (i.e. there was no felt analagous to the final press top felt (18).) Each of the felts had wash showers. The machine had 7 wire cylinders (i.e. vats) situated in series somewhat analagously to the two vats (72) and (73) shown in FIG. 2, and produced board (e.g. straw board, tube stock, chipboard or chipboard partition) from 100% recycle furnish.

The paper web formed on the cylinders separated from the cylinders and adhered to the underside of a primary bottom felt. While on the primary bottom felt the sheet was pressed between the primary bottom felt and an suction drum couch felt and then was directed through about four other presses between the primary bottom felt and a primary top felt. The sheet was then separated from the primary bottom felt and directed to a secondary press, somewhat analagous to press (57) in FIG. 1, where it was pressed between the secondary top felt and the secondary bottom felt. The sheet was in turn separated from the secondary press felts and directed to the final felt where it was pressed again at a press somewhat analagous to press (59) in FIG. 1 using a top press roll without a felt.

Prior to testing the combination of cationic polymer and cationic surfactant of the instant invention, the primary bottom felt, the suction drum couch felt, the primary top felt and the secondary top felt were pretreated in a conventional manner with alkyldimethyl benzyl ammonium chloride product containing the mixture of $C_{12}$, $C_{14}$ and $C_{16}$ n-alkyl substituents described above, using showers situated somewhat analagously to showers (107), (108), (109) and (50) respectively in FIGS. 1 and 2. In the test, a test product containing approximately 7.5% by weight of the alkyldimethyl benzyl ammonium chloride mixture, 7.5% by weight of a polymer having a molecular weight of about 20,000 and derived from dimethylamine and epichlorohydrin, and about 85% by weight solvent (i.e. the same product that was used in Example I) was diluted in the shower water to an estimated concentration of about 2.6 ppm each of surfactant and polymer and applied to the same four felts. After the felts had shown no plugging as a result of polymer addition during the initial application period, the concentrations of the surfactant and polymer were each raised 50% (to an estimated level of about 4 ppm). The treatment was continued at this level for the remainder of the test run. Each of the components was applied to each felt at a rate of about 1.5 grams/minute during the initial portion of the test and about 2.25 grams/minute during the remainder of the test. The primary bottom felt, the suction drum couch felt, the primary top felt, and the secondary top felt were all about 7.75 feet wide and were respectively about 104 feet, 62 feet, 66 feet and 42 feet long (i.e. the treatment areas were respectively about 74.9 $m^2$, 44.7 $m^2$, 47.5 $m^2$ and 30.3 $m^2$).

During the test relative porosities as measured by vacuum (e.g. inches Hg) were monitored across the widths of the treated felts as well as across the width of the untreated secondary bottom felt. A substantial increase in vacuum would represent deterioration of the felt. The results are shown in Tables I through V.

TABLE I

PRIMARY BOTTOM FELT POROSITY

| Time (Min.) After Start | Feed Rates (Approximate) g/min/$m^2$ Polymer | Surfactant | Relative Porosity (inches Hg) Front End | Front Center | Center | Back Center | Back End |
|---|---|---|---|---|---|---|---|
| Following Pretreatment | | | 9 | 8 | 10 | 11 | 8 |
| 0 | Feed Started | | — | — | — | — | — |
| 5 | 0.02 | 0.02 | 9 | 8 | 10 | 11 | 8 |
| 40 | 0.02 | 0.02 | 11 | 9 | 8 | 8 | 8 |
| 65 | 0.02 | 0.02 | 10 | 8 | 8 | 8 | 8 |
| 100 | 0.03 | 0.03 | 10 | 10 | 9 | 9 | 10 |
| 135 | 0.03 | 0.03 | 11 | 10 | 10 | 10 | 9 |
| 215 | 0.03 | 0.03 | 10 | 10 | 9 | 9 | 10 |
| 245 | Feed Stopped | | — | — | — | — | — |
| 265 | 0 | 0 | 10 | 10 | 10 | 10 | 10 |

TABLE II

SUCTION DRUM COUCH FELT POROSITY

| Time (Min.) After Start | Feed Rates (Approximate) g/min/$m^2$ Polymer | Surfactant | Relative Porosity (inches Hg) Front End | Front Center | Center | Back Center | Back End |
|---|---|---|---|---|---|---|---|
| Following Pretreatment | | | 2 | 2 | 2 | 2 | 2 |
| | Feed Started | | — | — | — | — | — |
| 5 | 0.03 | 0.03 | 2 | 2 | 2 | 2 | 2 |
| 40 | 0.03 | 0.03 | 3 | 3 | 3 | 2 | 3 |
| 65 | 0.03 | 0.03 | 3 | 3 | 3 | 3 | 3 |
| 100 | 0.05 | 0.05 | 2 | 2 | 2 | 2 | 2 |
| 135 | 0.05 | 0.05 | 3 | 3 | 2 | 2 | 2 |
| 215 | 0.05 | 0.05 | 4 | 4 | 3 | 3 | 5 |
| 245 | Feed Stopped | | — | — | — | — | — |
| 265 | 0 | 0 | 3 | 3 | 3 | 3 | 3 |
| 290 | 0 | 0 | 4 | 3 | 3 | 3 | 3 |

TABLE III

PRIMARY TOP FELT POROSITY

| Time (Min.) After Start | Feed Rates (Approximate) g/min/$m^2$ Polymer | Surfactant | Relative Porosity (inches Hg) Front End | Front Center | Center | Back Center | Back End |
|---|---|---|---|---|---|---|---|
| Following Pretreatment | | | 3 | 4 | 4 | 4 | 4 |
| | Feed Started | | — | — | — | — | — |
| 5 | 0.03 | 0.03 | 3 | 4 | 4 | 4 | 4 |
| 40 | 0.03 | 0.03 | 4 | 4 | 4 | 4 | 4 |

TABLE III-continued

PRIMARY TOP FELT POROSITY

| Time (Min.) After Start | Feed Rates (Approximate) g/min/m² Polymer | Surfactant | Relative Porosity (inches Hg) Front End | Front Center | Center | Back Center | Back End |
|---|---|---|---|---|---|---|---|
| 65 | 0.03 | 0.03 | 4 | 4 | 4 | 4 | 4 |
| 100 | 0.05 | 0.05 | 4 | 4 | 4 | 4 | 4 |
| 135 | 0.05 | 0.05 | 5 | 5 | 5 | 4 | 4 |
| 215 | 0.05 | 0.05 | 5 | 5 | 4 | 5 | 5 |
| 245 | Feed Stopped | | — | — | — | — | — |
| 265 | 0 | 0 | 5 | 4 | 4 | 4 | 4 |

TABLE IV

SECONDARY TOP FELT POROSITY

| Time (Min.) After Start | Feed Rates (Approximate) g/min/m² Polymer | Surfactant | Relative Porosity (inches Hg) Front End | Front Center | Center | Back Center | Back End |
|---|---|---|---|---|---|---|---|
| Following Pretreatment | | | 2 | 3 | 3 | 3 | 3 |
| Feed Started | | | — | — | — | — | — |
| 5 | 0.05 | 0.05 | 2 | 3 | 3 | 3 | 3 |
| 40 | 0.05 | 0.05 | 2 | 1 | 1 | 0 | 1 |
| 65 | 0.05 | 0.05 | 2 | 2 | 3 | 3 | 3 |
| 100 | 0.07 | 0.07 | 2 | 3 | 2 | 2 | 2 |
| 135 | 0.07 | 0.07 | 3 | 3 | 2 | 2 | 2 |
| 215 | 0.07 | 0.07 | 4 | 4 | 5 | 4 | 4 |
| 245 | Feed Stopped | | — | — | — | — | — |
| 265 | 0 | 0 | 4 | 4 | 5 | 4 | 4 |

TABLE V

SECONDARY BOTTOM FELT POROSITY (UNTREATED)

| Time (Min.) After Start | Feed Rates (Approximate) g/min/m² Polymer | Surfactant | Relative Porosity (inches Hg) Front End | Front Center | Center | Back Center | Back End |
|---|---|---|---|---|---|---|---|
| Following Pretreatment | | | 3 | 3 | 5 | 4 | 5 |
| Feed Started | | | — | — | — | — | — |
| 5 | 0 | 0 | 3 | 3 | 5 | 4 | 5 |
| 40 | 0 | 0 | 5 | 4 | 4 | 5 | 4 |
| 65 | 0 | 0 | 5 | 5 | 4 | 4 | 4 |
| 100 | 0 | 0 | 4 | 4 | 4 | 4 | 3 |
| 135 | 0 | 0 | 5 | 5 | 5 | 4 | 5 |
| 215 | 0 | 0 | 5 | 5 | 5 | 3 | 3 |
| 265 | 0 | 0 | 5 | 5 | 3 | 4 | 5 |

It will be evident from Tables I through V that cationic polymer can be applied to papermill felts in accordance with this invention without plugging the felts and destroying their porosity. Press loadings (i.e. the pressure applied by the press rolls of the six presses in the papermaking machine) remained unchanged throughout the test period; and vacuum pressures (i.e. the suction applied to remove liquid from the felts) measured at 13 points amongst the primary bottom felt, the suction drum couch felt, the primary top felt, the secondary top felt and the secondary bottom felt, also remain unchanged thoughout the test period. The couch vacuum remained unchanged during the test. Various sheet characteristics were also monitored during the test and are summarized in Table VI.

TABLE VI

SHEET CHARACTERISTICS

| Time (Min.) After Start | Speed (m/min) | Moisture (percent) | Basis Weight (g/m²) | Caliper* (microns) |
|---|---|---|---|---|
| After Pretreatment | 69.6 | 5.9 | 552.4 | 802.9 |

TABLE VI-continued

SHEET CHARACTERISTICS

| Time (Min.) After Start | Speed (m/min) | Moisture (percent) | Basis Weight (g/m²) | Caliper* (microns) |
|---|---|---|---|---|
| Machine Speed Reduced before Start of Test | | | | |
| 15 | 66.9 | 4.6 | 557.3 | 820.4 |
| 50 | 66.9 | 3.2 | 538.9 | 813.9 |
| 60 Stock flow increased due to low moisture and caliper | | | | |
| 100 Treatment Feed Rate Increased | | | | |
| 215 | 69.6 | 4.5 | 550.2 | 823.8 |
| 245 Treatment Stopped | | | | |
| 265 | 71.4 | 4.9 | 551.7 | 822.6 |

*It was discovered that caliper was reading 25 microns higher than actual due to computer error.

The pH of the paper stock was kept at about 6 and the temperature of the vat was about 38° C. The stock consistency was about 0.37% for cylinders 1 and 7, and was about 0.40% for cylinders 2, 3, 4, 5 and 6. The grade of paper remained unchanged during the test. Optimum moisture content had been considered to be about 5%, and the optimum caliper had been considered to be about 800.

It will be evident from Table VI that favorable sheet moisture content could be maintained during treatment, and that the high speed could be maintained during and after conditioning of the felts in accordance with this invention.

EXAMPLE III

The testing of this example was made on a papermaking machine having a single wire Fourdrinier with a pick-up felt and a series of presses and felts leading to a Yankee Drier. The machine normally processed furnish having a substantial proportion (i.e. between about 40% to 100%) of de-inked recycle pulp. The paper stock was typically kept at a pH of 6.0–6.5 and at a temperature of about 40° C.; and the mill production rate was about 50 tons per day.

Prior to the testing, the felt required up to 15 washings per day with organic solvent and/or blends of organic solvent with detergent. About 5 gallons of solvent per wash (i.e. up to about 75 gallons of solvent per day) were used. Solvent washes were performed on the run as dictated by sheet quality. Considerable quantities of paper could not be sold due to poor sheet quality. The de-inked recycle pulp, while relatively low cost and therefore desirable in high proportions, was considered to have contributed to runnability problems during processing which could in turn result in sheet imperfections and/or breaks. As a practical matter, the proportion of de-inked pulp which could be used was typically limited to a maximum of about 60%.

Prior to the testing, a new replacement pick-up felt, about 2.7 meters wide and 16.2 meters long, was installed. Two lube showers were provided for the pick-up felt. Felts of this type had exhibited typical shelf lives of about 50 days. A new low pressure fan shower was installed for the testing on the sheet side of the felt about 3 feet before the suction box. The shower utilized fresh water and had 13 nozzles, each rated at 2 U.S. gallons per minute.

In the testing, a test product containing approximately 7.5% by weight of an alkyldimethyl benzyl ammonium chloride mixture, about 7.5% of a polymer having a molecular weight of about 20,000 and derived from dimethylamine and epichlorohydrin, and about 85% by weight solvent (i.e. the same product that was used in Examples I and II) was diluted in the fresh shower water of the new low pressure shower to an estimated concentration of about 34 ppm each of surfactant and polymer, and applied to the felt at a rate of about 0.09 g/m$^2$-min each of surfactant and polymer.

While felt porosity was not monitored at this mill, within several hours of the start of the testing it was evident that the solvent cleaning frequency for the felt could be reduced. Moreover, the de-inked pulp content in the furnish was increased to 100%. The solvent wash frequency was reduced to 5 to 12 washings per day for five days, and the solvent required per wash was reduced to about 3 gallons per wash, resulting in a reduction of daily solvent usage by about half (i.e. up to about 36 gallons per day).

The low pressure shower was then relocated to a new position after the suction box. The solvent wash frequency dropped further to about 3 times per day. The new shower position was thus considered to represent an improvement.

The furnish content was then changed to 60% de-inked pulp/40% virgin furnish. For this grade, the solvent wash frequency decreased to approximately one wash per day.

In sum, even from this preliminary testing which lasted about 18 days, it was evident that treatment of the felt at this machine in accordance with the invention described herein could provide considerable cost savings by facilitating the use of furnish having high de-inked pulp content without causing unacceptable runnability problems, by reducing the number of solvent washes required for efficient production and the volume of solvent used for washing, and by reducing the amount of off-quality finished paper.

The examples describe various embodiments of the invention. Other embodiments will be apparent to those skilled in the art from a consideration of the specification or practice of the invention disclosed herein. It is understood that modifications and variations may be practiced without departing from the spirit and scope of the novel concepts of this invention. It is further understood that the invention is not confined to the particular formulations and examples herein illustrated, but it embraces such modified forms thereof as come within the scope of the following claims.

What is claimed is:

1. A method of inhibiting the deposit of sticky material on a papermill felt used in processing pulp slurry into sheets, comprising the step of:

applying to said papermill felt an aqueous solution which is substantially free of anionic macromolecules and which contains at least about 2 ppm of a cationic polymer having a molecular weight between about 2,000 and 300,000; and which contains a water soluble cationic surfactant, said surfactant having a molecular weight between about 200 and 800, applied in an amount effective to inhibit the buildup of deposits derived from the cationic polymer and wherein the weight ratio of surfactant to polymer is between about 50:1 to 1:1.

2. A method according to claim 1 wherein the cationic polymer is a dicyandiamide formaldehyde condensate polymer optionally including at least one compound selected from the group consisting of formic acid and ammonium salts as polymerization reactants.

3. A method according to claim 2 in which the cationic polymer is derived from a reaction between formaldehyde, dicyandiamide, formic acid, and ammonium chloride.

4. A method according to claim 1 wherein the cationic polymer is obtained by reaction between an epihalohydrin and one or more amines, or is derived from ethylenically unsaturated monomers which contain a quaternary ammonium group.

5. A method according to claim 1 wherein the cationic polymer is protonated or contains quaternary ammonium groups.

6. A method according to claim 1 wherein the cationic polymer is derived by reacting an epihalohydrin with at least one compound selected from the group consisting of diethylamine, dimethylamine, and methylethylamine.

7. A method according to claim 6 wherein the cationic polymer is made by reacting epichlorohydrin with dimethylamine.

8. A method according the claim 6 wherein the cationic polymer is made by reacting epichlorohydrin with diethylamine.

9. A method according to claim 1 in which the concentration of the cationic polymer in the aqueous solution is between about 0.0002 and about 0.02 weight percent.

10. A method according to claim 1 wherein the papermill felt cycles between a sheet contact stage and a return stage wherein the aqueous solution is applied to the papermill felt during its return stage.

11. A method according to claim 10 in which the cationic polymer is applied at a rate of at least about 0.002 g/m$^2$-min.

12. A method according to claim 10 in which the felt receives sheet material from vats of a vat forming machine.

13. A method according to claim 10 in which the felt receives sheet material from a wire of a Fourdrinier wire former.

14. A method according to claim 10 in which continuous treatment of the felt with the aqueous solution is practiced.

15. A method according to claim 14 in which the cationic polymer is applied at a rate of at least about 0.01 g/m$^2$-min.

16. A method, according to claim 10 in which the treatment of the felt with the aqueous solution is intermittent.

17. A method according to claim 16 in which the cationic polymer is applied at a rate of at least about 0.02 g/m$^2$-min during the application period.

18. A method according to claim 1 wherein the felt is used in a system wherein at least about 10% of papermill pulp fibers are derived from recycled material.

19. A method according to claim 1 wherein the felt is used in a system wherein papermill pulp fibers are derived about 100% from recycled material.

20. A method according to claim 1 wherein the felt is used in a system wherein the papermill pulp slurry is substantially derived from pine wood containing about 2 weight percent or more of resin.

21. The method of claim 1 wherein the cationic surfactant is selected from those surfactants having the general formula

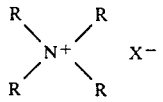

wherein each R is independently selected from the group consisting of hydrogen polyethylene oxide groups, polypropylene oxide groups, alkyl groups having between about 1 and 22 carbon atoms, aryl groups, and aralkyl groups, at least one of said R groups being an alkyl group having at least about 8 carbon atoms, and wherein $X^-$ is an anion, or 1/n of an n-valent anion.

22. A method according to claim 21 wherein at least one R group of said surfactant is an n-alkyl group having between about 12 and 16 carbon atoms.

23. A method according to claim 22 wherein two of the R groups of said surfactant are selected from methyl and ethyl, and one R group is selected from

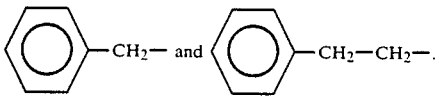

24. A method according to claim 22 wherein the surfactant is an alkyl dimethyl ammonium chloride or a mixture of alkyl dimethyl ammonium chlorides.

25. A method of treating papermill felts which cycle between a sheet contact stage and a return stage and are used in processing pulp slurry into sheets to inhibit the deposit of sticky hydrophobic material on the felt comprising the step of:

applying to the felt during the return stage an aqueous solution which is substantially free of anionic macromolecules and which contains (i) at least about 2 ppm of a cationic polymer which has a molecular weight between about 10,000 and about 300,000, and (ii) a water soluble surfactant having a molecular weight between about 200 and 800 and having the general formula

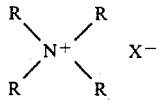

wherein each R is independently selected from the group consisting of hydrogen, polyethylene oxide groups, polypropylene oxide groups, alkyl groups having between about 1 and 22 carbon atoms, aryl groups, and aralkyl groups, at least one of said R groups being an alkyl group having at least about 8 carbon atoms, and wherein $X^-$ is an anion, or 1/n of an n-valent anion; the weight ratio of surfactant to polymer being between about 50:1 to 1.1; said surfactant being applied to the felt in an amount effective to inhibit build-up of deposits derived from said cationic polymer; and said cationic polymer being applied at an effective rate between about 0.002 and 0.5 grams per minute per square meter of felt such that the cationic polymer and the surfactant interact with the hydrophobic material so that it substantially loses its tendency to adhere to the felt.

26. The method of claim 25 wherein the papermill felts are used in a system selected from those wherein recycled fibers account for at least about 10 percent of the fibers in the system and those wherein 5 percent or more of the fiber is derived from pine wood containing greater than two weight percent resin.

27. The method of claim 25 wherein the felt is routinely treated at least once during the cycle between the sheet contact stage and the return stage, and wherein the cationic polymer is applied at a rate of at least about 0.01 grams per minute per square meter of felt.

28. The method of claim 25 wherein the aqueous solution is sprayed on the felt at a rate of at least about 0.02 grams of cationic polymer per minute per square meter of felt until satisfactory conditioning has been established, and wherein the spray is then discontinued until supplemental conditioning is needed to further inhibit the build-up of deposits on the felt.

29. A method of controlling the deposit of adhesive material on papermill felts in a papermaking system where recycled fibers account for at least about 10 percent of the fibers in the system, and where the felts cycle between a sheet contact stage and a return stage and are used to process pulp slurry containing both anionic macromolecules and adhesive material into sheets, the method comprising the step of:

contacting the felt during the return stage with an aqueous solution which is substantially free of anionic macromolecules and contains (i) at least about 2 ppm of a cationic polymer which has a molecular weight between about 10,000 and about 3,000,000 and (ii) a water soluble surfactant having a molecular weight between about 200 and 800 and having a general formula

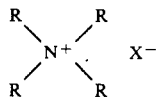

wherein each R is independently selected from the group consisting of hydrogen, polyethylene oxide groups, polypropylene oxide groups, alkyl groups having between about 1 and 22 carbon atoms, aryl groups, and aralkyl groups, at least one of said R groups being an alkyl group having at least about 8 carbon atoms, and wherein $X^-$ is an anion, or 1/n of an n-valent anion; said surfactant being applied to the felt in an amount effective to inhibit build-up of deposits derived from said cationic polymer; and said cationic polymer and surfactant being applied in a weight ratio of surfactant to polymer from about 10:1 to about 1:1, and interacting with the anionic macromolecules and adhesive materials to form products which can be easily removed from the felt.

30. The method of claim 29 wherein recycled fibers account for at least 70% of the fibers in the system, and wherein the cationic polymer is applied to the felt at a rate of at least about 0.002 grams per minute per square meter of felt.

* * * * *